US008521056B2

(12) United States Patent
Yoshioka et al.

(10) Patent No.: US 8,521,056 B2
(45) Date of Patent: Aug. 27, 2013

(54) DEVELOPING DEVICE AND IMAGE FORMING APPARATUS

(75) Inventors: Sakae Yoshioka, Kanagawa (JP); Masanori Kato, Kanagawa (JP); Ryuji Hattori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 286 days.

(21) Appl. No.: 13/109,419

(22) Filed: May 17, 2011

(65) Prior Publication Data

US 2012/0082487 A1 Apr. 5, 2012

(30) Foreign Application Priority Data

Oct. 1, 2010 (JP) ..... 2010-223582

(51) Int. Cl.
*G03G 15/08* (2006.01)
*G03G 15/09* (2006.01)

(52) U.S. Cl.
USPC ..... 399/104; 399/277

(58) Field of Classification Search
USPC ..... 399/103, 104, 274, 275, 277
See application file for complete search history.

(56) References Cited

U.S. PATENT DOCUMENTS

| | | | | |
|---|---|---|---|---|
| 6,185,393 | B1 * | 2/2001 | Karakama et al. | 399/103 |
| 8,331,834 | B2 * | 12/2012 | Koetsuka et al. | 399/277 |
| 2003/0012580 | A1 * | 1/2003 | Miyabe | 399/103 |
| 2006/0263111 | A1 | 11/2006 | Hamakawa et al. | |

FOREIGN PATENT DOCUMENTS

| | | | |
|---|---|---|---|
| JP | 2006-284889 | A | 10/2006 |
| JP | 2006-284896 | A | 10/2006 |
| JP | 2008-164942 | A | 7/2008 |

* cited by examiner

*Primary Examiner* — David Gray
*Assistant Examiner* — Gregory H Curran
(74) *Attorney, Agent, or Firm* — Sughrue Mion, PLLC

(57) ABSTRACT

A developing device includes a developing roller; a housing that retains the developing roller such that the developing roller has exposed and unexposed portions, end portions of the housing having first faces curved along the unexposed portion and second faces facing inward; a layer-thickness regulating member having an edge near the developing roller; a first magnet including a first magnetic pole that attracts the developer and a second magnetic pole located downstream of the first magnetic pole and upstream of the exposed portion in a rotational direction of the developing roller, the second magnetic pole having a magnetic force of about 60 mT or less; second magnets retained on the first faces; and magnetic plates retained on the second faces and arranged such that developer chains formed thereon at the downstream ends in the rotational direction extend to positions upstream of the edge of the layer-thickness regulating member.

8 Claims, 7 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2010-223582 filed Oct. 1, 2010.

BACKGROUND (i) Technical Field

The present invention relates to a developing device and an image forming apparatus.

(ii) Related Art

An example of a developing device includes a developing roller that faces an image carrier on which an electrostatic latent image is formed and develops the electrostatic latent image by transporting developer while rotating. In this type of developing device, it is desirable to suppress degradation of the developer and control the layer thickness of the developer retained on the developing roller at the same time.

SUMMARY

According to an aspect of the invention, there is provided a developing device including a cylindrical developing roller that faces an image carrier on which an electrostatic latent image is formed and develops the electrostatic latent image by transporting developer while rotating; a housing that retains the developing roller such that the developing roller has an exposed portion that is outwardly exposed at a side adjacent to the image carrier, the housing including a storage section at a side of the developing roller at which an unexposed portion, which is a portion excluding the exposed portion, is provided, the storage section storing the developer such that the developer is in contact with the developing roller, end portions of the housing in a rotational axis direction of the developing roller each having a first face and a second face, the first faces being curved in an arc shape along a surface of the unexposed portion of the developing roller, the second faces facing a central area in the rotational axis direction from the end portions and defining ends of the storage section in the rotational axis direction; a layer-thickness regulating member having an edge that extends in the rotational axis direction and that is in the vicinity of a surface of the developing roller at a boundary between the unexposed portion and the exposed portion in a rotational direction of the developing roller, the layer-thickness regulating member partially defining the storage section and regulating a layer thickness of the developer that is transported to the exposed portion by the rotation of the developing roller; a first magnet disposed in the developing roller and including plural magnetic poles that are arranged in the rotational direction and extend in the rotational axis direction, the magnetic poles including a first magnetic pole and a second magnetic pole, the first magnetic pole facing the storage section, extending in the rotational axis direction, and attracting the developer in the storage section to the developing roller, the second magnetic pole being located downstream of the first magnetic pole and upstream of the exposed portion in the rotational direction of the developing roller, extending in the rotational axis direction, and applying a transporting force to the developer that passes through a gap between the developing roller and the layer-thickness regulating member; second magnets retained on the first faces, the second magnets being curved in an arc shape in the rotational direction of the developing roller and extending along the surface of the developing roller with gaps provided between the developing roller and the second magnets; and magnetic plates retained on the second faces and having edges that are in the vicinity of the developing roller and extend along the rotational direction of the developing roller at boundaries between a central portion and end portions of the developing roller, the central portion partially defining the storage section and the end portions being in the vicinity of the first faces. The second magnetic pole has a magnetic force of about 60 mT or less. The magnetic plates are arranged such that developer chains formed on the magnetic plates at downstream ends thereof in the rotational direction of the developing roller extend to positions upstream of the edge of the layer-thickness regulating member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described.

Figure 1:
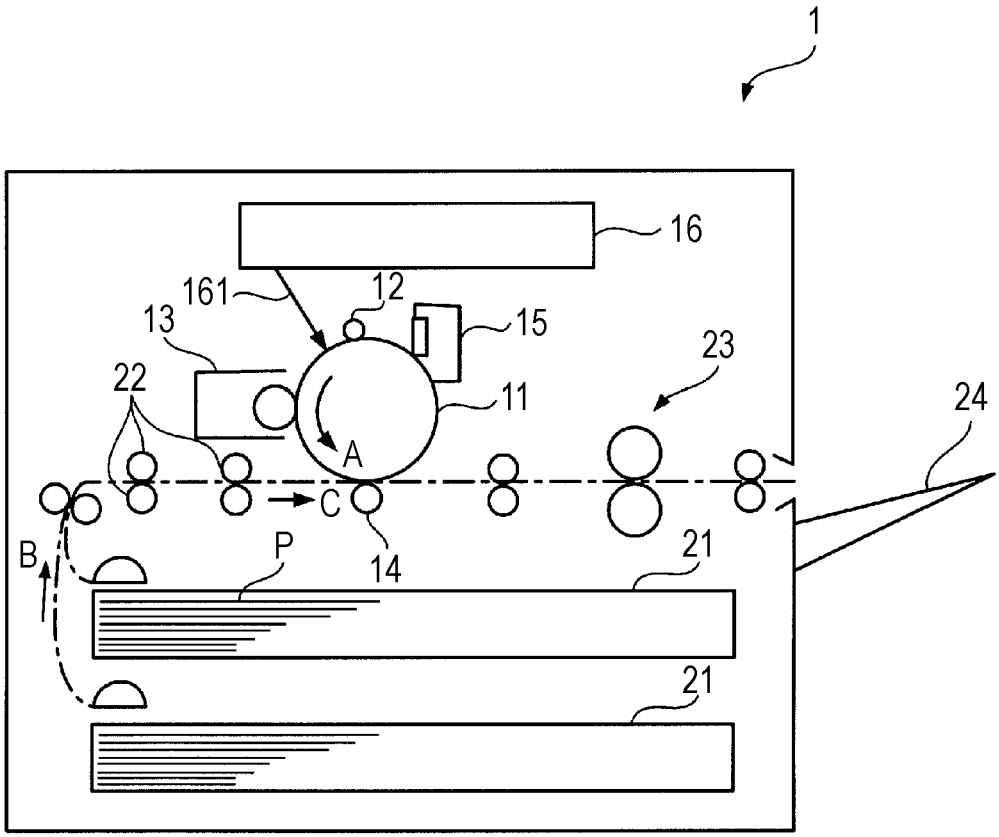
FIG. 1 is a schematic diagram illustrating an image forming apparatus according to a first exemplary embodiment of the present invention.

FIG. 1 is a schematic diagram illustrating an image forming apparatus 1 according to a first exemplary embodiment of the present invention.

The image forming apparatus 1 includes a photoconductor 11 in a substantially central area thereof. The photoconductor 11 is drum-shaped, and rotates in a direction shown by arrow A around a rotational axis that extends perpendicular to FIG. 1.

A charging unit 12, a developing unit 13, a transferring unit 14, and a cleaner 15 are arranged around the photoconductor 11. An exposure unit 16 is disposed above the photoconductor 11. The photoconductor 11 is charged by the charging unit 12, and is then irradiated with exposure light 161 emitted from the exposure unit 16. The developing unit 13 is a developing device according to the present exemplary embodiment of the present invention.

Two sheet storage units 21 are disposed in a lower part of the image forming apparatus 1. Sheets P of paper are stored in the sheet storage units 21 in a stacked manner. One of the sheets P is taken out from one of the sheet storage units 21. The sheet P that has been taken out is transported by transport rollers 22 in directions shown by arrows B and C, and is ejected onto a paper output tray 24.

In an image forming process, the surface of the photoconductor 11 that rotates in the direction shown by arrow A is charged by the charging unit 12, and is then irradiated with the exposure light 161. The exposure light 161 is emitted from the exposure unit 16, and corresponds to an image. Accordingly, an electrostatic latent image is formed. The electrostatic latent image is developed by the developing unit 13, so that a developer image is formed on the photoconductor 11.

The sheet P that has been taken out from one of the sheet storage units 21 and transported in the directions shown by arrows B and C is fed to a transfer position, at which the transferring unit 14 is arranged, in synchronization with the time at which the developer image on the photoconductor 11 reaches the transfer position. Then, the developer image on the photoconductor 11 is transferred onto the sheet P by the operation of the transferring unit 14.

The sheet P onto which the developer image has been transferred is further transported to a fixing unit 23, which applies heat and pressure to the sheet P to fix the developer image. Thus, the developer image is fixed to the sheet P. The sheet P on which the image is formed is further transported and ejected to the paper output tray 24.

After the developer image is transferred onto the sheet P by the operation of the transferring unit 14, the developer that remains on the photoconductor 11 is removed by the cleaner 15. Then, the photoconductor 11 is charged by the charging unit 12 again.

Figure 2:
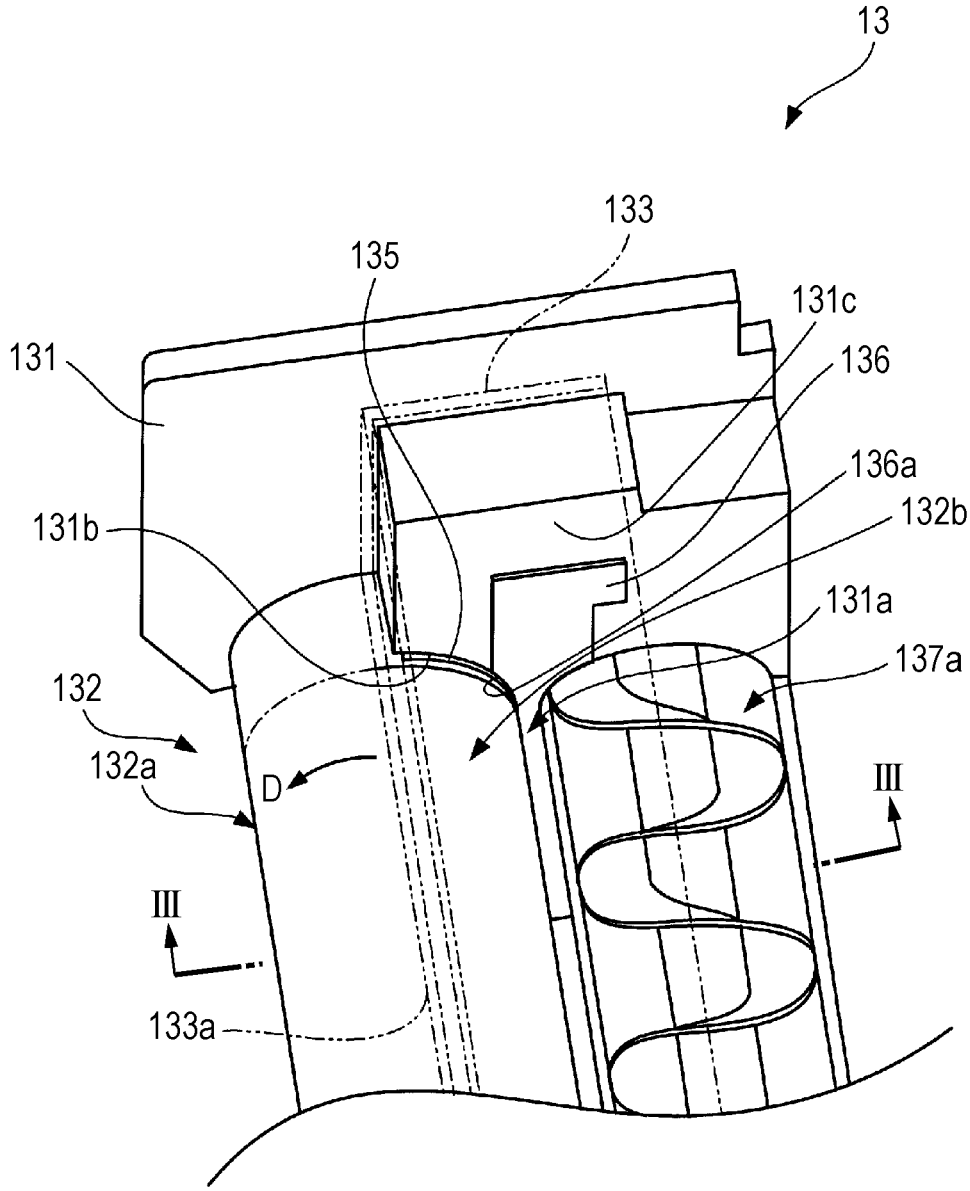
FIG. 2 is a perspective view illustrating an end portion of a developing unit, wherein a layer-thickness regulating member is drawn in a see-through manner.
Figure 3:
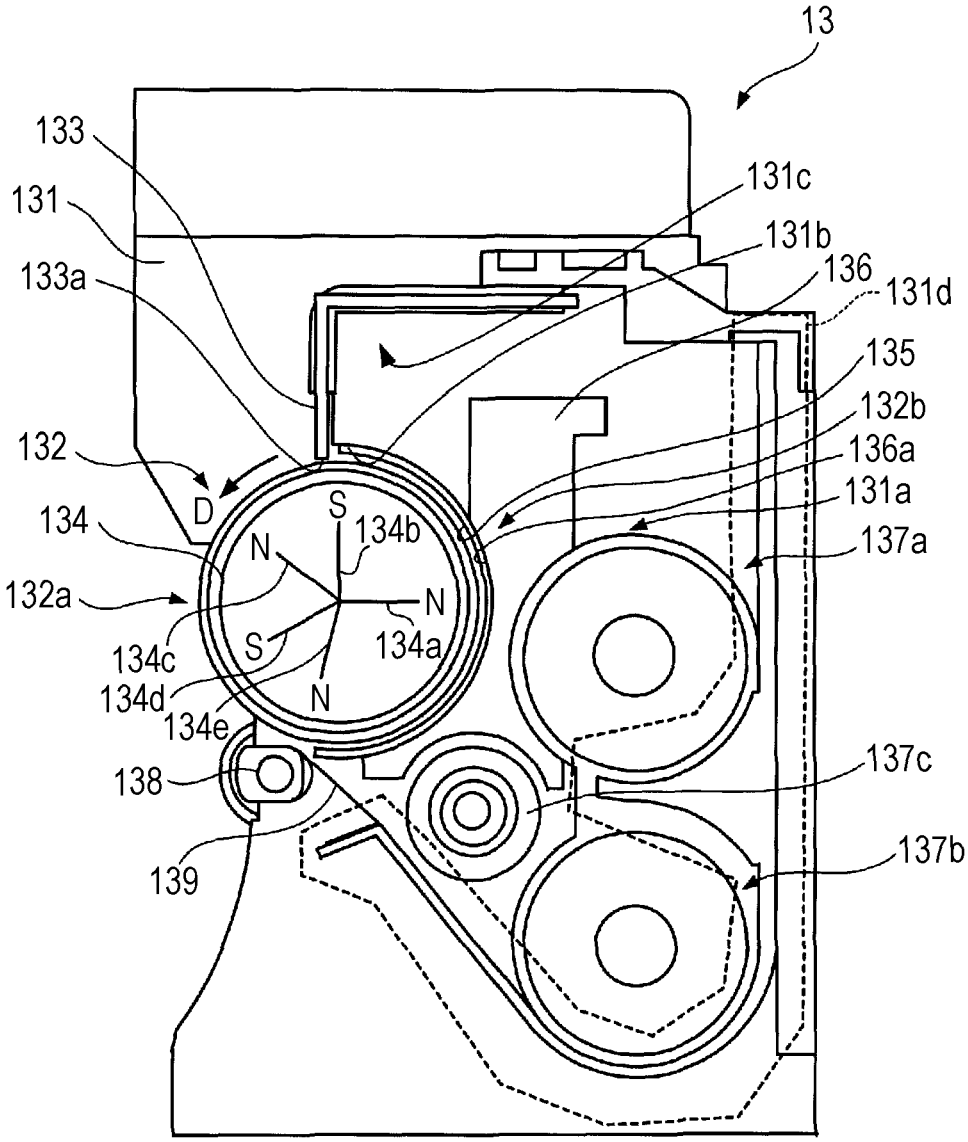
FIG. 3 is a sectional view of the end portion of the developing unit taken along line III-III in FIG. 2.

FIG. 2 is a perspective view illustrating an end portion of the developing unit 13, wherein a layer-thickness regulating member is drawn in a see-through manner. FIG. 3 is a sectional view of the end portion of the developing unit 13 taken along line III-III in FIG. 2;

Referring to FIG. 2, the developing unit 13 includes a housing 131, a developing roller 132, a layer-thickness regulating blade 133, a magnet 134 (see FIG. 3), magnet rubber members 135 (see FIG. 3), and magnetic plates 136.

The developing roller 132 is a cylindrical roller that faces the photoconductor 11 (see FIG. 1) on which the electrostatic latent image is formed. The developing roller 132 develops the electrostatic latent image on the photoconductor 11 by transporting the developer while rotating in the direction shown by arrow D.

The housing 131 retains the developing roller 132 such that the developing roller 132 has an exposed portion 132*a* that is outwardly exposed at a side adjacent to the photoconductor 11. The housing 131 includes a storage section 131*a* at a side of the developing roller 132 at which an unexposed portion 132*b*, which is a portion excluding the exposed portion 132*a*, is provided. The storage section 131*a* stores the developer such that the developer is in contact with the developing roller 132. The housing 131 includes a wall 131*d* that is shaped as shown by dashed lines in FIG. 3 in cross section and that extends in a rotational axis direction of the developing roller 132. The storage section 131*a* is partially defined by the wall 131*d*, and is formed between the wall 131*d* and the developing roller 132. The developer in the storage section 131*a* is stirred and reciprocated in the rotational axis direction of the developing roller 132 by three augers 137*a*, 137*b*, and 137*c* (see FIG. 3), and the amount of developer is made uniform in the rotational axis direction. End portions of the housing 131 in the rotational axis direction of the developing roller 132 each include a first face 131*b* and a second face 131*c*. The first faces 131*b* are curved in an arc shape along the surface of the unexposed portion 132*b* of the developing roller 132. The second faces 131*c* face the central area in the rotational axis direction from the end portions and define the ends of the storage section 131*a* in the rotational axis direction.

The layer-thickness regulating blade 133 defines the storage section 131*a* together with the housing 131 and regulates the layer thickness of the developer that is transported to the exposed portion 132*a* by the rotation of the developing roller 132. The layer-thickness regulating blade 133 includes an edge 133*a* that extends in the rotational axis direction. The edge 133*a* is in the vicinity of the surface of the developing roller 132 at the boundary between the unexposed portion 132*b* and the exposed portion 132*a* in a rotational direction of the developing roller 132 (direction shown by arrow D). The edge 133*a* serves to regulate the layer thickness of the developer that is transported toward the exposed portion 132*a* through a gap between the developing roller 132 and the layer-thickness regulating blade 133. The gap between the edge 133*a* of the layer-thickness regulating blade 133 and the surface of the developing roller 132 is set to an appropriate distance in the range of 0.5 mm or more and 0.8 mm or less so that the developer layer having an expected thickness is formed on the developing roller 132.

The magnet 134 in the developing roller 132 illustrated in FIG. 3 has magnetic poles which each extend in the rotational axis direction. More specifically, a first magnetic pole 134*a* faces the storage section 131*a* and serves to attract the developer in the storage section 131*a* to the developing roller 132. A second magnetic pole 134*b* is located downstream of the first magnetic pole 134*a* and upstream of the exposed portion 132*a* in the rotational direction of the developing roller 132. The second magnetic pole 134*b* serves to apply a transporting force to the developer that passes through the gap between the developing roller 132 and the layer-thickness regulating blade 133. A third magnetic pole 134*c* serves to transport the developer retained by the developing roller 132 after the regulation of the layer thickness. A fourth magnetic pole 134*d* faces the photoconductor 11 (see FIG. 1) and serves to attract carrier included in the developer, which develops the electrostatic latent image on the photoconductor 11, to the developing roller 132. A fifth magnetic pole 134*e* is the N-pole, similar to the first magnetic pole 134*a*, and serves to remove the developer from the developing roller 132. Of the above-mentioned magnetic poles 134*a* to 134*e*, the second magnetic pole 134*b* has a magnetic force of 60 mT or about 60 mT in the present exemplary embodiment. Here, 60 mT is considerably low compared to a magnetic force that is generally used to apply the transporting force to the developer that passes through the gap between the developing roller 132 and the layer-thickness regulating blade 133. No particular lower limit is set for the magnetic force of the second magnetic pole 134*b*. However, when the magnetic force is 30 mT or less, a sufficient transporting force cannot be obtained even when the structure of the present exemplary embodiment, which will be described below, is used.

The magnet rubber members 135 are retained on the first faces 131*b* of the end portions of the housing 131 in the rotational axis direction of the developing roller 132, the first faces 131*b* being curved in an arc shape along the surface of the unexposed portion 132*b* of the developing roller 132. The magnet rubber members 135 are flexible, plate-shaped magnets that are curved in an arc shape in the rotational direction of the developing roller 132 and expand along the surface of the developing roller 132 with gaps provided between the developing roller 132 and the magnet rubber members 135. The gaps between the developing roller 132 and the magnet rubber members 135 are filled with developer chains formed by the magnet rubber members 135. Thus, the magnet rubber members 135 serve to prevent the developer from leaking through the gaps in the rotational axis direction.

The magnetic plates 136 are retained on the second faces 131*c* of the housing 131. The second faces 131*c* face the central area from the end portions in the rotational axis direction and define the ends of the storage section 131*a* in the rotational axis direction. The magnetic plates 136 have first edges 136*a* at the boundaries between a central portion and end portions of the developing roller 132. The end portions of the developing roller 132 are portions in the vicinity of the first faces 131*b* on which the magnet rubber members 135 are retained. The central portion of the developing roller 132 is a portion that is in contact with the developer stored in the storage section 131*a* and that faces the storage section 131*a* so as to partially define the storage section 131*a*. The first edges 136*a* of the magnetic plates 136 are located in the vicinity of the developing roller 132 and extend in the rotational direction of the developing roller 132. The developer chains are also formed between the developing roller 132 and the first edges 136*a* of the magnetic plates 136. Thus, the magnetic plates 136 also serve to prevent the developer from leaking through the gaps between the developing roller 132 and the first edges 136*a* and the gaps between the developing roller 132 and the first faces 131*b* on which the magnet rubber members 135 are retained.

The developing unit 13 includes a seal roller 138 and a metal plate 139 that are located below the developing roller 132. The metal plate 139 is in contact with the seal roller 138. The seal roller 138 and the metal plate 139 serve to prevent the developer retained on the surface of the developing roller 132 from falling off when the developer is transported from the exposed portion 132*a* to the unexposed portion 132*b*.

Figure 4:
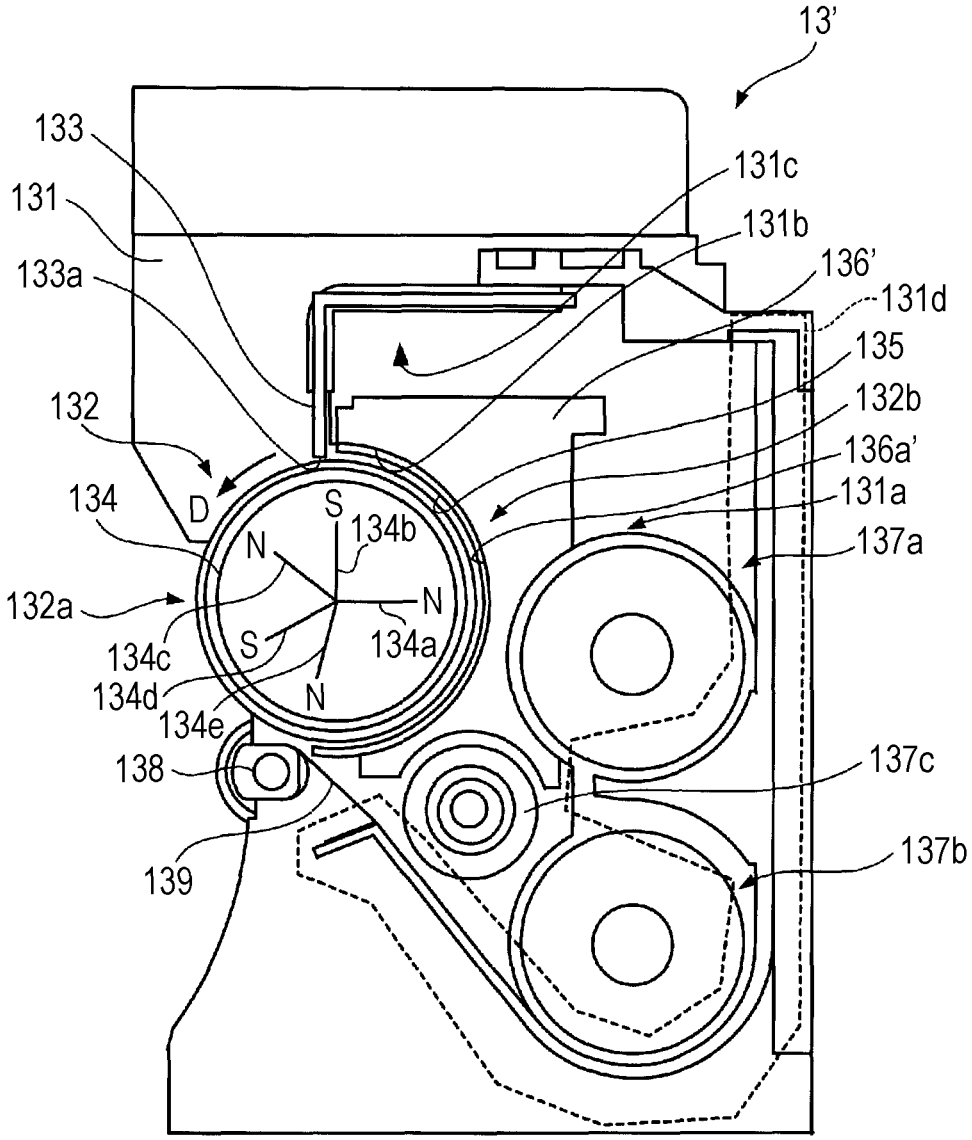
FIG. 4 is a sectional view of a developing unit according to a comparative example that corresponds to the sectional view of FIG. 3.

FIG. 4 is a sectional view of a developing unit according to a comparative example that corresponds to the sectional view of FIG. 3.

Components similar to those of the developing unit illustrated in FIGS. 2 and 3 are denoted by the same reference numerals, and only differences from the developing unit illustrated in FIGS. 2 and 3 will be described.

The magnetic plates 136 of the developing unit 13 according to the present exemplary embodiment illustrated in FIG. 3 differ from magnetic plates 136' included in a developing unit 13' according to the comparative example illustrated in FIG. 4.

The magnetic plates 136 of the developing unit 13 according to the present exemplary embodiment illustrated in FIG. 3 are smaller than the magnetic plates 136' of the developing unit 13' illustrated in FIG. 4. More specifically, the magnetic plates 136' according to the comparative example (see FIG. 4) also have first edges 136*a'* that are located in the vicinity of the developing roller 132 and extend in the rotational direction of the developing roller 132. In the comparative example, downstream ends of the first edges 136*a'* in the rotational direction of the developing roller 132 (direction shown by arrow D) are near the second magnetic pole 134*b* of the magnet 134. In contrast, in the magnetic plates 136 according to the present exemplary embodiment (see FIG. 3), downstream ends of the first edges 136*a* in the rotational direction of the developing roller 132 are located closer to the first magnetic pole 134*a* than to the second magnetic pole 134*b*.

Another difference is that, although not shown in the figures, the magnetic force of the second magnetic pole 134*b* according to the present exemplary embodiment is 60 mT or about 60 mT, as described above, whereas the magnetic force of the second magnetic pole 134*b* according to the comparative example (see FIG. 4) is 80 mT.

Figure 5A:
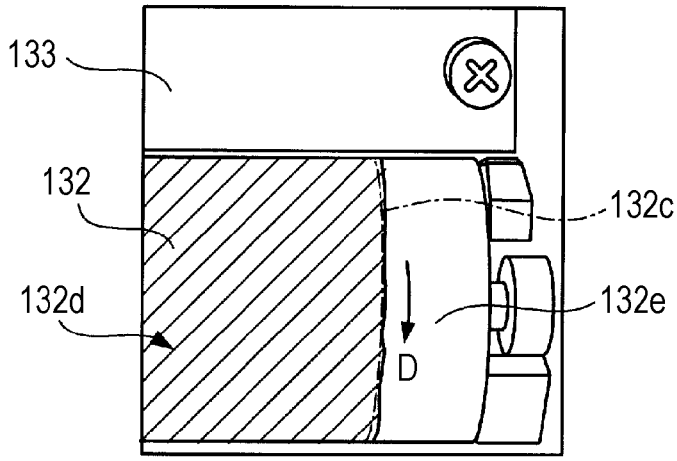
FIGS. 5A to 5C are diagrams illustrating the developer retained on an exposed portion of a developing roller.
Figure 5B:
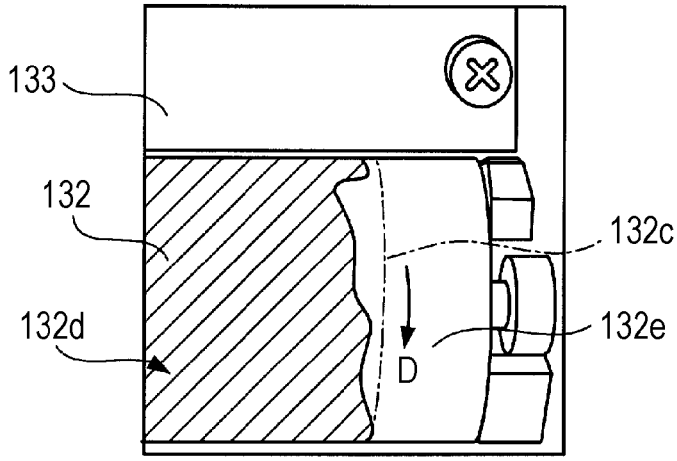
Figure 5C:
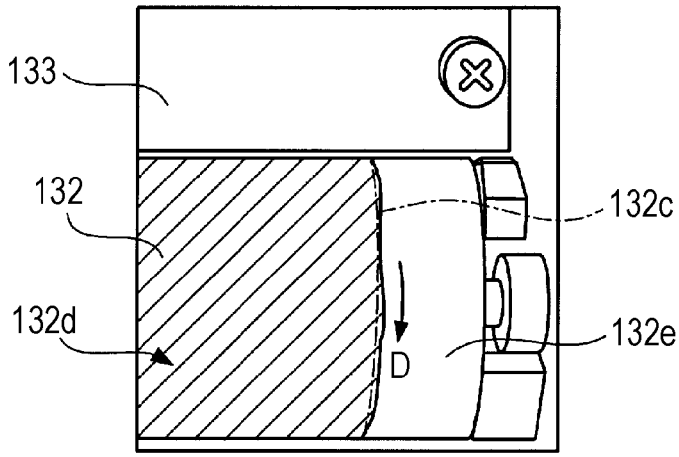

FIGS. 5A to 5C are diagrams illustrating the developer retained on the exposed portion of the developing roller 132.

FIG. 5A corresponds to the comparative example illustrated in FIG. 4. FIG. 5B shows the case in which the magnetic force of the second magnetic pole 134*b* is reduced to 60 mT or about 60 mT in the structure of the comparative example illustrated in FIG. 4 and in which the gap between the developing roller 132 and the layer-thickness regulating blade 133 is increased.

FIG. 5C illustrates the exemplary embodiment illustrated in FIG. 3. The difference between FIGS. 5B and 5C is the difference between the magnetic plates 136 and 136' (see FIGS. 3 and 4).

In each of FIGS. 5A to 5C, the one-dot chain line 132*c* shows the boundary between a central portion 132*d* that comes into contact with the developer stored in the storage section and one of end portions 132*e* which are in the vicinity of the housing 131 and at which leakage of the developer is prevented by the magnet rubber members 135 and the magnetic plates 136. In each of FIGS. 5A to 5C, the hatched areas show the developer that has passes through the gap between the developing roller 132 and the layer-thickness regulating blade 133.

In FIG. 5A, the developer expands over the entire area of the central portion 132*d* of the developing roller 132, which is a normal state. This state is achieved because the magnetic force of the second magnetic pole 134*b* is large (80 mT), and the developer is attracted to the developing roller 132 by the large magnetic force so that the developer is caused to pass through the small gap between the developing roller 132 and the layer-thickness regulating blade 133 by a large transporting force. In this case, a normal developer layer may be formed. However, the developer receives a large stress and degradation of the developer cannot be avoided.

In FIG. 5B, the developer does not expand over the entire area of the central portion 132*d* of the developing roller 132, and the developer is not retained in an area of the central portion 132*d* that is near the end portion 132*e*. Even if the developer is retained, the layer thickness of the developer is small in the area near the end portion 132*e*. However, the layer thickness is normal except for that in the area of the central portion 132*d* that is near the end portion 132*e*. When the image forming process is performed in this state, if an image to be formed extends to positions very close to the end portions, there is a risk that an image defect will occur. More specifically, there is a risk that end portions of the image cannot be formed or the density thereof will be reduced.

The area illustrated in FIG. 5B in which the developer is not retained is formed owing to the reduction in the magnetic force of the second magnetic pole 134*b* to 60 mT or about 60 mT and the influence of the magnetic plates 136' (see FIG. 4). The influence of the magnetic plates 136' will be described in more detail below with reference to FIGS. 6A to 6C.

In FIG. 5C, similar to FIG. 5A, the developer expands over the entire area of the central portion 132*d* of the developing roller 132, which is a normal state. Similar to the case of FIG. 5B, the magnetic force of the second magnetic pole 134*b* is set to 60 mT or about 60 mT. However, as illustrated in FIG. 3, the magnetic plates 136 are farther away from the second magnetic pole 134*b* than the magnetic plates 136' illustrated in FIG. 4, and the influence of the magnetic plates 136 on the formation of the developer layer is reduced accordingly. In the case of FIG. 5C, a normal developer layer may be formed, and the risk that an image defect will occur is reduced. In addition, since the magnetic force of the second magnetic pole 134*b* is reduced to 60 mT or about 60 mT, degradation of the developer may be reduced compared to that in the comparative example illustrated in FIGS. 4 and 5A.

Figure 6A:
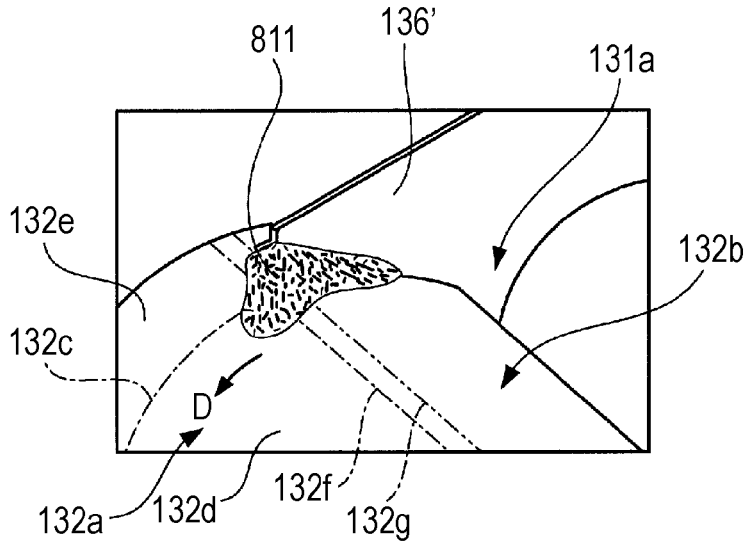
FIGS. 6A to 6C illustrate developer chains formed at the downstream end of a magnetic plate in the rotational direction of the developing roller.
Figure 6B:
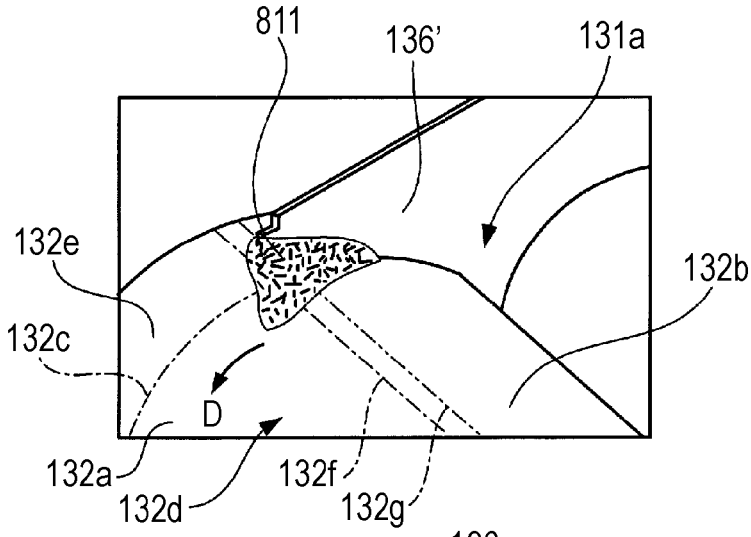
Figure 6C:
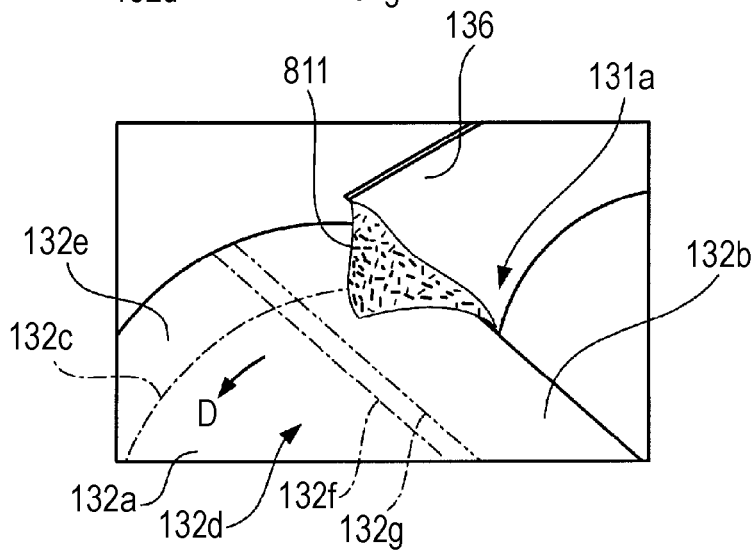

FIGS. 6A to 6C illustrate the developer chains formed at the downstream end of one of the magnetic plates in the rotational direction of the developing roller 132.

Here, the layer-thickness regulating blade 133 (see FIGS. 2 to 4) is detached and the developer is removed from the storage section 131*a*. Then, an amount of developer that is enough to form the developer chains (for example, 5 g of developer) is supplied to the magnetic plates 136 and 136' at the side that faces the layer-thickness regulating blade 133, and the developing roller 132 is rotated until the excess developer falls off and stable developer chains are formed.

FIGS. 6A and 6C illustrate the thus-formed stable developer chains.

In each of FIGS. 6A to 6C, the one-dot chain line 132*f* shows the position on the developing roller 132 at which the layer-thickness regulating blade 133 is closest to the developing roller 132. In addition, the two-dot chain line 132*g* shows the position at which the second magnetic pole 134*b* of the magnet 134 (see FIGS. 2 and 3) placed in the developing roller 132 faces outward.

The area on the left side of the one-dot chain line 132*f* corresponds to the exposed portion 132*a* of the developing roller 132 that is disposed outside the housing 131 (see FIGS. 2 to 4) and exposed, and the area on the right side of the one-dot chain line 132*f* corresponds to the unexposed portion 132*b* of the developing roller 132 that is disposed in the housing 131.

Similar to FIGS. 5A to 5C, the one-dot chain line 132*c* shows the boundary between the central portion 132*d* of the developing roller 132 and one of the end portions 132*e*.

FIG. 6A corresponds to FIG. 5A, and shows the case in which the magnetic force of the second magnetic pole 134*b* is large (80 mT) and each magnetic plate 136' extends to a position near the layer-thickness regulating blade.

In this case, developer chains 811 formed at the downstream end of each magnetic plate 136' in the rotational direction of the developing roller 132 expand into the exposed portion 132*a* beyond the one-dot chain line 132*f* at which the layer-thickness regulating blade is to be arranged. Here, the developer chains 811 are observed in the state in which the layer-thickness regulating blade is detached. When the layer-thickness regulating blade is attached, the developer chains 811 are blocked by the layer-thickness regulating blade. In such a case, the developer chains 811 exist only in the unexposed portion 132*b* and do not expand beyond the one-dot chain line 132*f*.

Even though the developer chains 811 are formed so as to expand beyond the one-dot chain line 132*f* as illustrated in FIG. 6A, the developer receives a large transporting force since the magnetic force of the second magnetic pole 134*b* is large (80 mT). Accordingly, as illustrated in FIG. 5A, the developer layer that expands over the entire area of the central portion 132*d* may be formed.

FIG. 6B corresponds to FIG. 5B, and shows the case in which the magnetic force of the second magnetic pole 134*b* is reduced to 60 mT or about 60 mT. Similar to the case of FIG. 6A, each magnetic plate 136' extends to a position near the layer-thickness regulating blade.

Also in FIG. 6B, the developer chains 811 expand into the exposed portion 132*a* beyond the one-dot chain line 132*f*. In the case of FIG. 6B, the magnetic force of the second magnetic pole 134*b* is reduced to 60 mT or about 60 mT, and the transporting force applied to the developer is reduced as a result. Accordingly, the gap between the layer-thickness regulating blade and the developing roller is adjusted. In this case, a developer layer having an expected thickness may be formed on the central portion 132*d* in an area excluding the area near the boundary between the central portion 132*d* and the end portion 132*e*. However, in the area near the boundary between the central portion 132*d* and the end portion 132*e*, formation of the developer layer is impeded by the developer chains 811 (see FIG. 6B). As a result, as illustrated in FIG. 5B, there is a risk that an area in which the developer layer is not formed or in which the thickness of the developer layer is smaller than the expected thickness will be formed. In such a case, there is a risk that an image defect will occur.

FIG. 6C corresponds to FIG. 5C, and shows the case in which the magnetic force of the second magnetic pole 134*b* is reduced to 60 mT or about 60 mT and each magnetic plate 136 extends to a position separated from the layer-thickness regulating blade, as described above with reference to FIG. 3. In this case, the developer chains 811 exist only in an area upstream of the one-dot chain line 132*f*, at which the layer-thickness regulating blade is disposed, in the rotational direction of the developing roller 132, and do not reach the one-dot chain line 132*f*. Thus, the size and arrangement of each magnetic plate 136 are set such that the developer chains 811 formed on the magnetic plate 136 do not come into contact with the layer-thickness regulating blade. In this case, as illustrated in FIG. 5C, the developer layer having an expected thickness may be formed over the entire area of the central portion 132*d* of the developing roller 132 including the boundary between the central portion 132*d* and the end portion 132*e*.

Unlike the magnetic plates 136' (see FIG. 4), the magnetic plates 136 (see FIGS. 2 and 3) expand only in the upstream area of the developing roller 132 in the rotational direction thereof. Therefore, there may be a concern about leakage of the developer in the rotational axis direction in an area immediately upstream (on the inner side) of the layer-thickness regulating blade 133. However, it is confirmed that leakage of the developer may be prevented by the magnet rubber members 135 since the magnet rubber members 135 extend to positions near the layer-thickness regulating blade 133.

Figure 7:
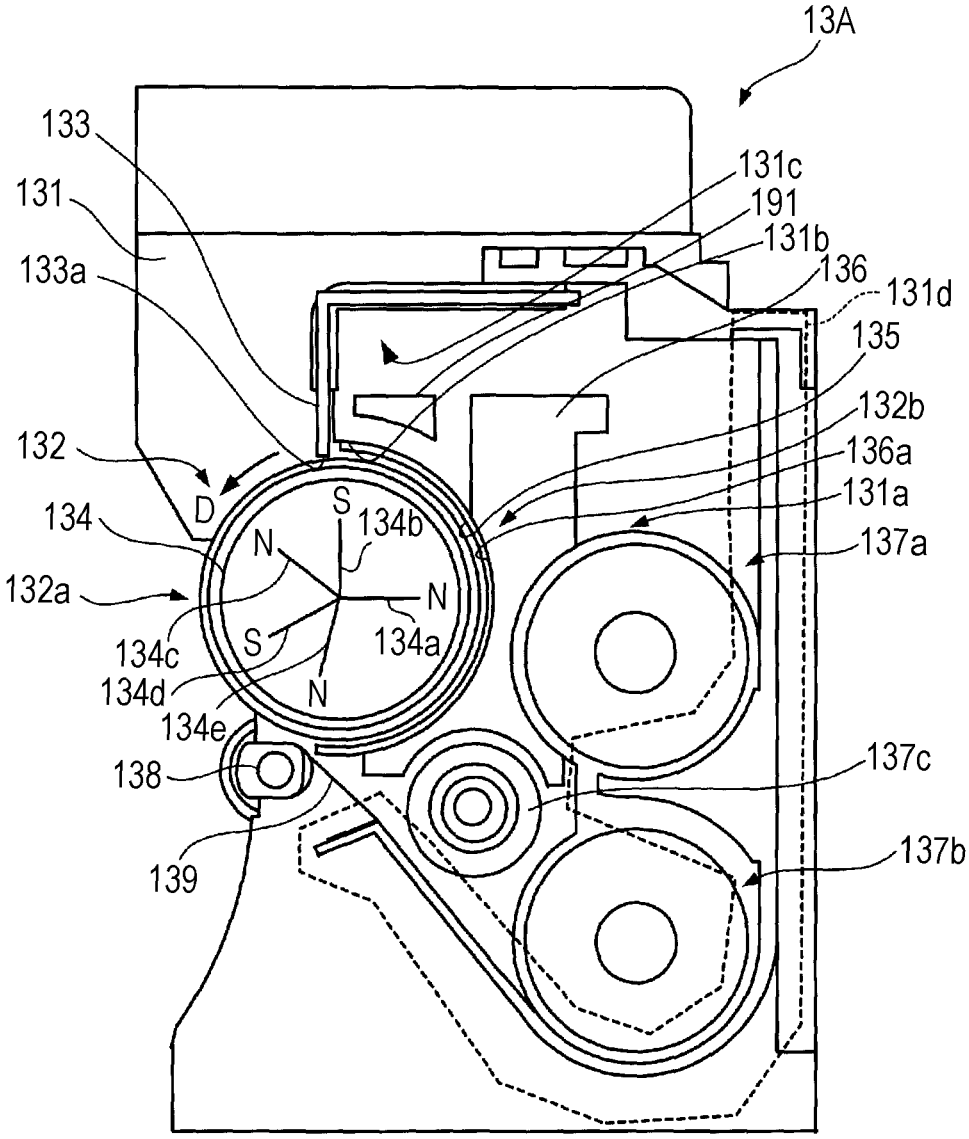
FIG. 7 is a sectional view of a developing unit according to a second exemplary embodiment.

FIG. 7 is a sectional view of a developing unit 13A according to a second exemplary embodiment. FIG. 7 corresponds to FIG. 3 according to the first exemplary embodiment. Components similar to those of the developing unit 13 illustrated in FIG. 3 are denoted by the same reference numerals, and only differences from the developing unit 13 will be described.

The developing unit 13A illustrated in FIG. 7 includes second magnetic plates 191 in addition to the components of the developing unit 13 illustrated in FIG. 3. Similar to the magnetic plates 136, the second magnetic plates 191 are also retained on the second faces 131*c* of the housing 131. The second faces 131*c* are the faces that define the ends of the storage section 131*a*, in which the developing device is stored, in the rotational axis direction of the developing roller 132. The second magnetic plates 191 are positioned between the layer-thickness regulating blade 133 and the magnetic plates 136 in the rotational direction of the developing roller 132, and are farther from the developing roller 132 than the magnetic plates 136. The second magnetic plates 191 serve to expand the developer chains 811 (see FIG. 6C) toward the layer-thickness regulating blade 133. When the second magnetic plates 191 are arranged so as to moderately expand the developer chains 811 toward the layer-thickness regulating blade 133 such that the developer layer on the developing roller 132 is not adversely affected, leakage of the developer in the rotational axis direction may be more reliably prevented.

Magnets, such as magnet rubber members, may be used in place of the second magnetic plates 191.

In the above description, the developing unit included in the image forming apparatus illustrated in FIG. 1 is explained as an example. However, exemplary embodiments of the present invention may be applied to various types of image forming apparatuses, such as an image forming apparatus including an intermediate transfer body, an image forming apparatus including multiple units which each include a photoconductor and a developing unit, and an image forming apparatus including a rotary developing device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a cylindrical developing roller that faces an image carrier on which an electrostatic latent image is formed and develops the electrostatic latent image by transporting developer while rotating;

a housing that retains the developing roller such that the developing roller has an exposed portion that is outwardly exposed at a side adjacent to the image carrier, the housing including a storage section at a side of the developing roller at which an unexposed portion, which is a portion excluding the exposed portion, is provided, the storage section storing the developer such that the developer is in contact with the developing roller, end portions of the housing in a rotational axis direction of the developing roller each having a first face and a second face, the first faces being curved in an arc shape along a surface of the unexposed portion of the developing roller, the second faces facing a central area in the rotational axis direction from the end portions and defining ends of the storage section in the rotational axis direction;

a layer-thickness regulating member having an edge that extends in the rotational axis direction and that is in the vicinity of a surface of the developing roller at a boundary between the unexposed portion and the exposed portion in a rotational direction of the developing roller, the layer-thickness regulating member partially defining the storage section and regulating a layer thickness of the developer that is transported to the exposed portion by the rotation of the developing roller;

a first magnet disposed in the developing roller and including a plurality of magnetic poles that are arranged in the rotational direction and extend in the rotational axis direction, the magnetic poles including a first magnetic pole and a second magnetic pole, the first magnetic pole facing the storage section, extending in the rotational axis direction, and attracting the developer in the storage section to the developing roller, the second magnetic pole being located downstream of the first magnetic pole and upstream of the exposed portion in the rotational direction of the developing roller, extending in the rotational axis direction, and applying a transporting force to the developer that passes through a gap between the developing roller and the layer-thickness regulating member;

second magnets retained on the first faces, the second magnets being curved in an arc shape in the rotational direction of the developing roller and extending along the surface of the developing roller with gaps provided between the developing roller and the second magnets; and magnetic plates retained on the second faces and having edges that are in the vicinity of the developing roller and extend along the rotational direction of the developing roller at boundaries between a central portion and end portions of the developing roller, the central portion partially defining the storage section and the end portions being in the vicinity of the first faces, wherein the second magnetic pole has a magnetic force of about 60 mT or less, and wherein the magnetic plates are arranged such that developer chains formed on the magnetic plates at downstream ends thereof in the rotational direction of the developing roller extend to positions upstream of the edge of the layer-thickness regulating member.

2. The developing device according to claim 1, wherein downstream ends of the edges of the magnetic plates in the rotational direction of the developing roller are closer to the first magnetic pole than to the second magnetic pole in the rotational direction.

3. The developing device according to claim 1, further comprising:

second magnetic plates or third magnets disposed in the unexposed portion at positions farther away from the surface of the developing roller than the edges of the magnetic plates and downstream of the downstream ends of the edges of the magnetic plates in the rotational direction of the developing roller.

4. The developing device according to claim 2, further comprising:

second magnetic plates or third magnets disposed in the unexposed portion at positions farther away from the surface of the developing roller than the edges of the magnetic plates and downstream of the downstream ends of the edges of the magnetic plates in the rotational direction of the developing roller.

5. An image forming apparatus, comprising:

an image carrier on which an electrostatic latent image is formed and which carries a developer image formed by developing the electrostatic latent image;

a developing unit that develops the electrostatic latent image formed on the image carrier;

a transferring unit that transfers the developer image on the image carrier onto a recording medium; and a fixing unit that fixes the developer image transferred onto the recording medium to the recording medium, wherein the developing unit includes a cylindrical developing roller that faces the image carrier on which the electrostatic latent image is formed and develops the electrostatic latent image by transporting developer while rotating, a housing that retains the developing roller such that the developing roller has an exposed portion that is outwardly exposed at a side adjacent to the image carrier, the housing including a storage section at a side of the developing roller at which an unexposed portion, which is a portion excluding the exposed portion, is provided, the storage section storing the developer such that the developer is in contact with the developing roller, end portions of the housing in a rotational axis direction of the developing roller each having a first face and a second face, the first faces being curved in an arc shape along a surface of the unexposed portion of the developing roller, the second faces facing a central area in the rotational axis direction from the end portions and defining ends of the storage section in the rotational axis direction, a layer-thickness regulating member having an edge that extends in the rotational axis direction and that is in the vicinity of a surface of the developing roller at a boundary between the unexposed portion and the exposed portion in a rotational direction of the developing roller, the layer-thickness regulating member partially defining the storage section and regulating a layer thickness of the developer that is transported to the exposed portion by the rotation of the developing roller, a first magnet disposed in the developing roller and including a plurality of magnetic poles that are arranged in the rotational direction and extend in the rotational axis direction, the magnetic poles including a first magnetic pole and a second magnetic pole, the first magnetic pole facing the storage section, extending in the rotational axis direction, and attracting the developer in the storage section to the developing roller, the second magnetic pole being located downstream of the first magnetic pole and upstream of the exposed portion in the rotational direction of the developing roller, extending in the rotational axis direction, and applying a transporting force to the developer that passes through a gap between the developing roller and the layer-thickness regulating member, second magnets that are plate-shaped and retained on the first faces, the second magnets being curved in an arc shape in the rotational direction of the developing roller and extending along the surface of the developing roller with gaps provided between the developing roller and the second magnets, and magnetic plates retained on the second faces and having edges that are in the vicinity of the developing roller and extend along the rotational direction of the developing roller at boundaries between a central portion and end portions of the developing roller, the central portion partially defining the storage section and the end portions being in the vicinity of the first faces, wherein the second magnetic pole has a magnetic force of about 60 mT or less, and wherein the magnetic plates are arranged such that developer chains formed on the magnetic plates at downstream ends thereof in the rotational direction of the developing roller extend to positions upstream of the edge of the layer-thickness regulating member.

6. The image forming apparatus according to claim 5, wherein downstream ends of the edges of the magnetic plates in the rotational direction of the developing roller are closer to the first magnetic pole than to the second magnetic pole in the rotational direction.

7. The image forming apparatus according to claim 5, further comprising:

second magnetic plates or third magnets disposed in the unexposed portion at positions farther away from the surface of the developing roller than the edges of the magnetic plates and downstream of the downstream ends of the edges of the magnetic plates in the rotational direction of the developing roller.

8. The image forming apparatus according to claim 6, further comprising:

second magnetic plates or third magnets disposed in the unexposed portion at positions farther away from the surface of the developing roller than the edges of the magnetic plates and downstream of the downstream ends of the edges of the magnetic plates in the rotational direction of the developing roller.

* * * * *